US009920995B2

(12) United States Patent
Longo

(10) Patent No.: US 9,920,995 B2
(45) Date of Patent: Mar. 20, 2018

(54) SAND DISPENSING SYSTEM AND METHOD OF DISPENSING SAND INTO A METAL MAKING FURNACE

(71) Applicant: Aldo Longo, Richmond Hill (CA)

(72) Inventor: Aldo Longo, Richmond Hill (CA)

( * ) Notice: Subject to any disclaimer, the term of this patent is extended or adjusted under 35 U.S.C. 154(b) by 180 days.

(21) Appl. No.: 14/529,499

(22) Filed: Oct. 31, 2014

(65) Prior Publication Data

US 2016/0123668 A1 May 5, 2016

(51) Int. Cl.

| | |
|---|---|
| ***F27D 3/00*** | (2006.01) |
| ***F27D 21/02*** | (2006.01) |
| ***C21B 3/02*** | (2006.01) |
| ***F27B 3/19*** | (2006.01) |
| ***F27D 3/15*** | (2006.01) |
| ***F27D 19/00*** | (2006.01) |
| ***F27D 21/00*** | (2006.01) |

(52) U.S. Cl.

CPC ..... *F27D 3/0033* (2013.01); *C21B 3/02* (2013.01); *F27B 3/19* (2013.01); *F27D 3/15* (2013.01); *F27D 3/1509* (2013.01); *F27D 3/1536* (2013.01); *F27D 19/00* (2013.01); *F27D 21/00* (2013.01); *F27D 21/02* (2013.01)

(58) Field of Classification Search

CPC ..... F27D 3/0033

USPC ..... 266/45, 272, 100

See application file for complete search history.

(56) References Cited

U.S. PATENT DOCUMENTS

| | | | | |
|---|---|---|---|---|
| 5,914,087 | A | 6/1999 | Fuchs | |
| 6,299,830 | B2 | 10/2001 | Raivo | |
| 7,468,090 | B2 | 12/2008 | Kemeny | |
| 2013/0320601 | A1 † | 12/2013 | Kephart | |
| 2016/0123668 | A1 * | 5/2016 | Longo | F27D 3/0033 266/44 |

FOREIGN PATENT DOCUMENTS

| | | |
|---|---|---|
| JP | H07004852 | † 10/1995 |
| JP | 2009209013 | 8/1997 |
| JP | 2005194579 | 7/2005 |

(Continued)

OTHER PUBLICATIONS

Author Unknown, High-Temperature Furnace Camera System, website p. entitled "Lenox Firesight Products", by Lenox Instrument Company, printed on Apr. 22, 2014.

*Primary Examiner* — Scott Kastler

(74) *Attorney, Agent, or Firm* — John Timothy Headley

(57) ABSTRACT

A sand dispensing system with a compact movable sand reservoir, mounted for movement atop a metal making furnace, is refillable with a predetermined amount of sand, and tilts with the furnace. The reservoir dispenses a directed stream of the predetermined amount of sand through a nozzle in a sump panel door to fill a tap hole in the furnace. One end of the nozzle receives the directed stream of sand. The opposite end of the nozzle projects into the furnace, to direct the sand stream into the tap hole when the sand reservoir is in the dispensing position. An imaging device may be used to inspect the tap hole before and after the sand is directed into the tap hole. A remote control may be used to operate the sand dispensing system. The predetermined amount may be adjusted as the fill volume of the tap hole increases.

38 Claims, 11 Drawing Sheets

(56) References Cited

FOREIGN PATENT DOCUMENTS

| | | | |
|---|---|---|---|
| JP | 2008156717 | | 7/2008 |
| KR | 101330306 | B1 † | 11/2013 |
| KR | 20130122112 | | 11/2013 |
| WO | 19970041264 | | 11/1997 |
| WO | 19970043592 | | 11/1997 |

* cited by examiner
† cited by third party

SAND DISPENSING SYSTEM AND METHOD OF DISPENSING SAND INTO A METAL MAKING FURNACE

FIELD OF THE INVENTION

The invention relates to a method and system of dispensing a predetermined amount of sand from a compact sand reservoir, via a nozzle, as a directed stream of sand into a tap hole of a metal making furnace, such as for example, a steel making furnace.

BACKGROUND

In metal making furnaces of the prior art, sand is filled into the furnace, and particularly into a tap hole before the furnace is filled with a charge of metal, for example, sorted scrap or other metal feedstock. For example, in steel making furnaces, a tap hole is often filled with sand in incremental amounts after an operator inspects the tap hole to determine whether additional sand is required to properly fill the tap hole. The operator may use a camera or other device to visually inspect the tap hole at several different times during the sand filling cycle. Often, there will be delays as the operator waits for a clear view of the tap hole, as dust settles after an incremental fill, to see whether additional sand must be dispensed to properly fill the tap hole.

In prior art sand filling systems, the sand is often dispensed directly from a bulk storage sand reservoir often located near the furnace, for example, on a structurally reinforced roof above the furnace, or on an interior floor space of the metal making plant. In those instances where the sand must be supplied as unguided charges of sand in discrete incremental steps, and particularly in those instances where the volume of sand must be adjusted to compensate for sand dispensed into the furnace, but not into the tap hole, production time will be lost dispensing additional increments of sand to properly fill the tap hole.

In some prior art systems, such as the system of US patent publication number US 2013/0320601 published on Dec. 5, 2013 by Nucor Corp., additional production time may be lost by operating a plunger to clear metal flash and other formations which may plug or obstruct an access port, for example, a chimney hole used as an unrestricted opening to fill sand into a tap hole in a steel making furnace. The chimney hole may be cleared by a remotely controlled plunger as disclosed in the Nucor application, or in some instances, the obstructions may be cleared manually by an operator who could be exposed to risk of injury while working in close proximity to the high temperature furnace. Any obstructions are removed and sand is incrementally charged into that tap hole after the operator performs visual inspections following each sand filling step, of which there would be several incomplete filling steps, until the sand filling is properly completed. Each incremental charging step adds to the production time for the metal making process. Similar issues may arise in those systems where an operator will interrupt the sand filling cycle to manually clear obstructions from chimney holes or similar openings used to supply sand into a metal making furnace. Therefore, it would be desirable to reduce the frequency and duration of any clearing steps and to reduce the risk to operators who might otherwise be required to approach an operating furnace to clear obstructions that might interfere with sanding of the furnace or inspecting the tap hole.

Often, an unnecessarily significant amount of sand may be lost as some of the sand is dispensed, unguided, into the furnace to accumulate adjacent but outside of the tap hole. The total additional volume of used sand which is dispensed and accumulated outside of the tap hole may represent a significant expense for each production cycle, and an even greater expense over a lengthy production period. In many instances it will be desirable to reduce the consumption of sand during operation of metal making furnaces.

It would also be desirable to reduce the operating time for a metal making furnace, where possible, by reducing the amount of time needed to dispense sand into the tap hole of a metal making furnace. In some instances, it may be desirable to more accurately direct a stream of a predetermined amount of sand into the tap hole.

The present invention may be applied to sanding systems and methods of sanding metal making furnaces, for example, steel making furnaces, to ameliorate one or more of these disadvantages or one or more of the other disadvantages associated with prior art sanding systems and methods which are known by persons skilled in the prior art.

SUMMARY OF THE INVENTION

The following presents a simplified summary of the invention in order to provide a basic understanding to the reader. This summary is not an extensive overview of the disclosure and it does not necessarily identify key/critical elements of the invention or delineate the scope of the invention. Its sole purpose is to present some concepts disclosed herein in a simplified form as a prelude to the more detailed description that is presented later.

In one aspect, the present invention is directed to a sand dispensing system for use in a steel making furnace. Although the following summary, and the description, will in part describe the application of the invention to steel making furnaces, skilled persons will appreciate that this invention may be readily adapted for use with other metal making furnaces. Similarly, other aspects of the invention include methods of sanding internal features, such as for example tap holes, for use in association with high temperature metal making furnaces, including steel making furnaces.

In one aspect, the sand dispensing system comprises a movable, and preferably compact, sand storage reservoir for dispensing a predetermined amount of sand into a tap hole of a steel making furnace. In this example, the sand storage reservoir moves between a first position away from a sump panel opening defined by a steel making furnace and a second position adjacent the sump panel opening. A sump panel door is provided to open and close the sump panel opening. A sump panel door cover is also provided to cover a nozzle extending through the sump panel door. The sump panel door is positioned above the sump panel opening. The nozzle extends through the sump panel door and the nozzle directs a stream of the predetermined amount of sand into a tap hole within the steel making furnace when the sand storage reservoir is in the second position.

In some embodiments, the nozzle may define a first open end extending inwardly beyond a top interior surface defined within the furnace. The nozzle may define a second open end projecting outwardly from the furnace configured so that the second open end receives the predetermined amount of sand when the sand storage reservoir is in the second position. The second open end of the nozzle may define a funnel, preferably a funnel which tapers inwardly toward the internal elongated channel defined by the nozzle.

The sand dispensing system may include a sump panel door cover which moves between a first position for closing the nozzle when the sand storage reservoir is in the first position and a second position for opening the nozzle when the sand storage reservoir is in the second position.

Preferably, the sand storage reservoir is of a compact design, configured to dispense a predetermined amount of sand sufficient to fill the tap hole. In many instances, the reservoir will be configured to hold one predetermined amount of sand sufficient to fill the tap hole. Typically, the single predetermined amount of sand will be discharged into the tap hole when the movable sand storage reservoir is in its second position. The predetermined amount of sand may be variable so that, for example, the predetermined amount of sand held within the reservoir, and dispensed into the tap hole, is increased when needed as the volume of the tap hole increases over the life cycle of a tap hole sleeve. When a worn or damaged tap hole sleeve is replaced with a new tap hole sleeve, the predetermined amount of sand may be varied, usually by decreasing the predetermined amount, so that the amount of sand to be dispensed from the reservoir will be sufficient to properly fill the tap hole defined by the new tap hole sleeve.

In another aspect, the sand storage reservoir is configured to be mounted atop a sump panel on the steel making furnace so that the sand storage reservoir moves above the sump panel between the first position away from the sump panel opening and the second position adjacent the sump panel opening. The sand dispensing system may include a remote control or an automated control to operate:

- the sand storage reservoir between the first position away from the sump panel opening and the second position adjacent the sump panel opening,
- a gate to dispense the predetermined amount of sand from the sand storage reservoir into the nozzle,
- a sump panel door cover moving between a first cover position for closing the nozzle when the sand storage reservoir is in the first position and a second cover position for opening the nozzle when the sand storage reservoir is in the second position, and
- an imaging device for remotely viewing the tap hole through the nozzle when the sump panel door cover is in the second cover position for opening the nozzle.

In a preferred embodiment, the sand dispensing system, including the sand storage reservoir, is configured to be mounted atop the steel making furnace so that the sand dispensing system will tip along with the furnace during the operational movement of the furnace. Preferably, the sand dispensing system is secured to the sump panel of the furnace, so that the various moving components of the dispensing system may travel between their respective positions relative to the sump panel opening.

In another embodiment, preferably automated or remotely controlled at least in part, the sand dispensing system comprises:

- a movable sand storage reservoir configured for mounting atop a steel making furnace for tilting movement along with the furnace and to hold and selectively dispense one predetermined amount of sand sufficient to fill a tap hole in the furnace,
- a sump panel door for closing and opening a sump panel opening defined by a top interior surface within the furnace,
- a nozzle extending through the sump panel door to direct a cohesive stream of the predetermined amount of sand into the tap hole when the nozzle is aligned with the tap hole,
- a sump panel door cover for opening and closing the nozzle,
- an imaging device for remotely viewing the tap hole through the nozzle when the sump panel door cover is retracted for opening the nozzle, and
- a remote control for operation of:
  - the sand storage reservoir,
  - the sump panel door,
  - a gate to dispense the predetermined amount of sand from the storage reservoir into the nozzle when the sump panel door cover is in the second position for opening the nozzle, and
  - the imaging device.

Preferably, the nozzle extends into the interior of the furnace so that the nozzle extends inwardly beyond a top interior surface defined by the furnace. In some embodiments, a portion of the top interior surface of the furnace may be defined by an interior surface of the panel door cover which faces inwardly toward the interior of the furnace. The nozzle may define a funnel at one end to receive the predetermined amount of sand dispensed from the sand storage reservoir. Preferably, the opening area measured across the internal diameter of the nozzle defines a minor portion of the total area of the sump panel opening. In many instances, the internal diameter of the nozzle is about 5 to 6 inches for use in a sump panel opening with a diameter of about 18 to 20 inches. In those instances where the sump panel opening of a typical steel making furnace is shaped as a rectangle (including a square), the length of each of the sides will often be about 18 to 20 inches in length. In the most preferred embodiment, the internal diameter of the nozzle is less than the internal diameter of the opening in the tap hole. Preferably, the nozzle is configured to generate a cohesive stream of sand which has a diameter less than the diameter of the opening in the tap hole.

In some embodiments, the sump panel door may be cooled internally by cooling fluid circulating about the sump panel door, preferably adjacent to the portion of the nozzle which extends through the sump panel door. The sump panel may also be cooled to enhance operator safety when an operator approaches the sump panel opening to access the interior of the furnace or service other components, for example, the sand dispensing system and its components. The operation of the cooling features within the sump panel door may be used to inhibit the accumulation of metal flash or obstructions across or within the interior opening of the nozzle. Such cooling features may be useful in causing metal flash and other potential debris to fall away from the top interior surface, thus discouraging the formation of obstructions within the nozzle opening. In those instances where the sump panel door is not cooled internally, the nozzle may be elongated to form a collar within the interior of the furnace so that the collar extends inwardly beyond the top interior surface of the sump panel door, which is preferably recessed above the top interior surface of the interior furnace chamber. The collar may be configured to inhibit the formation of metal flash or other obstructions which could bridge an otherwise continuous interior planar surface extending across a flush nozzle opening defined by the interior surface of the sump panel door.

Preferably, the predetermined amount of sand is adjustable to offset a variation in the fill volume of the tap hole.

In another aspect, the invention is a method of dispensing sand from a movable sand storage reservoir, comprising:

- moving the sand storage reservoir between a first position away from a sump panel opening defined by a steel making furnace and a second position adjacent the sump panel opening, operating a sump panel door cover for closing and opening a nozzle extending through a sump panel door positioned above the sump panel opening, and dispensing a predetermined amount of sand from the sand storage reservoir by directing a cohesive stream of the predetermined amount of sand, via the nozzle extending through the sump panel door, sufficient to fill a tap hole within the steel making furnace, when the sand storage reservoir is in the second position.

Preferably, the nozzle is sufficiently vertically aligned with the tap hole when the sand reservoir is in the second position, above the tap hole, to direct the cohesive stream into the tap hole. The nozzle is aimed to take into account the tilt of the furnace and the trajectory of the cohesive stream of the predetermined amount of sand when it is flowing into the tap hole.

Preferably, the predetermined amount of sand is released from the sand storage reservoir by opening a gate, into a funnel defined at a second end of the nozzle and through a first end of the nozzle which extends inwardly beyond a top interior surface defined within the furnace.

An imaging device may be remotely operated for remotely viewing the tap hole, through the nozzle, when the sump panel door cover is in the second position for opening the nozzle and the sand storage reservoir is in the second position.

Other embodiments of the invention, including other sand dispensing systems and other methods of dispensing sand into metal making furnaces, for example, steel making furnaces, will become apparent to those skilled in the art upon reading the specification of this application, including the description and drawings.

DRAWINGS

A preferred embodiment of the invention is illustrated and described herein having regard to the drawings in which.

DESCRIPTION OF A PREFERRED EMBODIMENT

Figure 1:
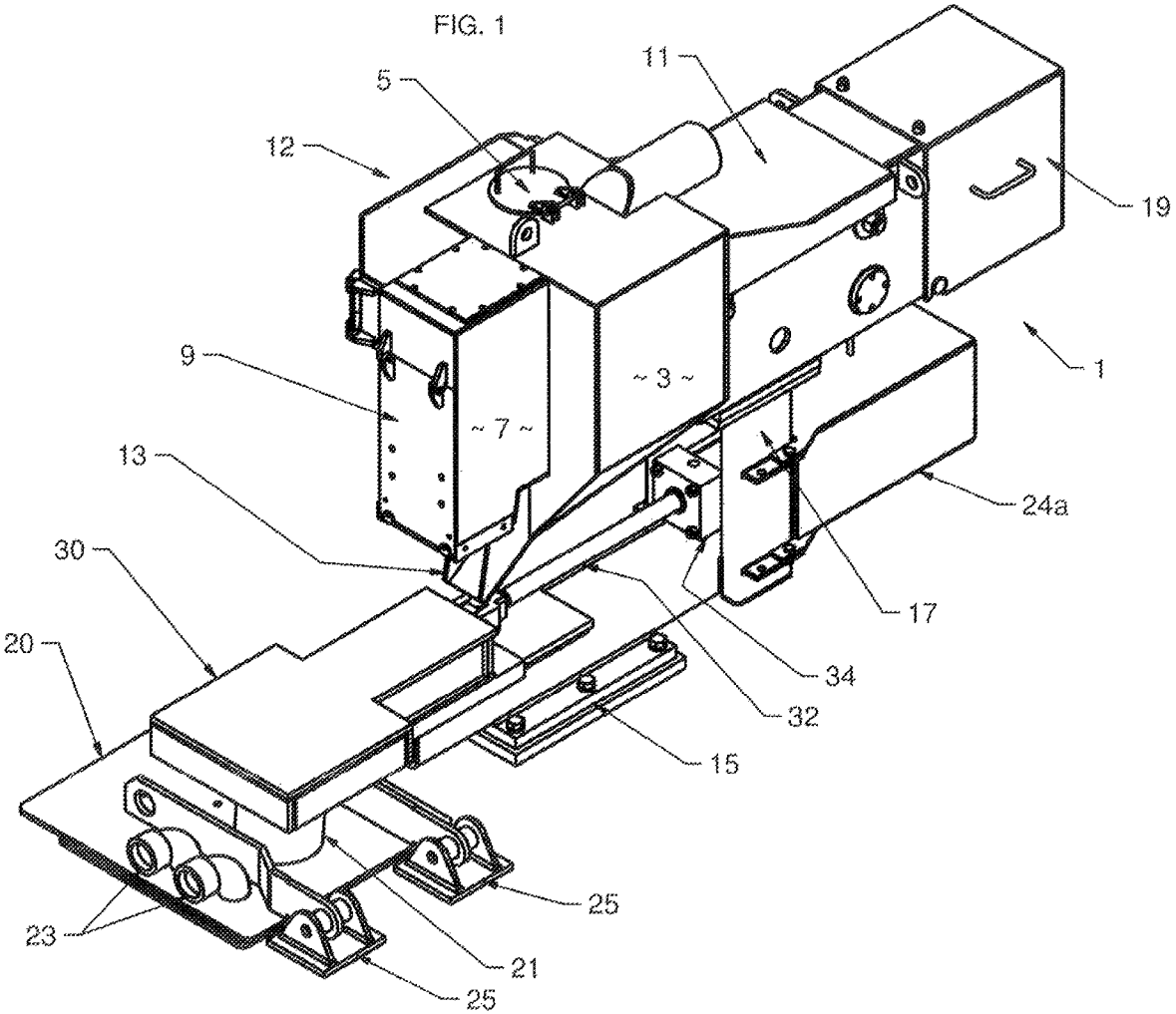
FIG. 1 is a side view in perspective of a preferred embodiment of a sand dispensing assembly of the present invention in a closed position in which a sump panel door cover is extended over a sump panel door.
Figure 2:
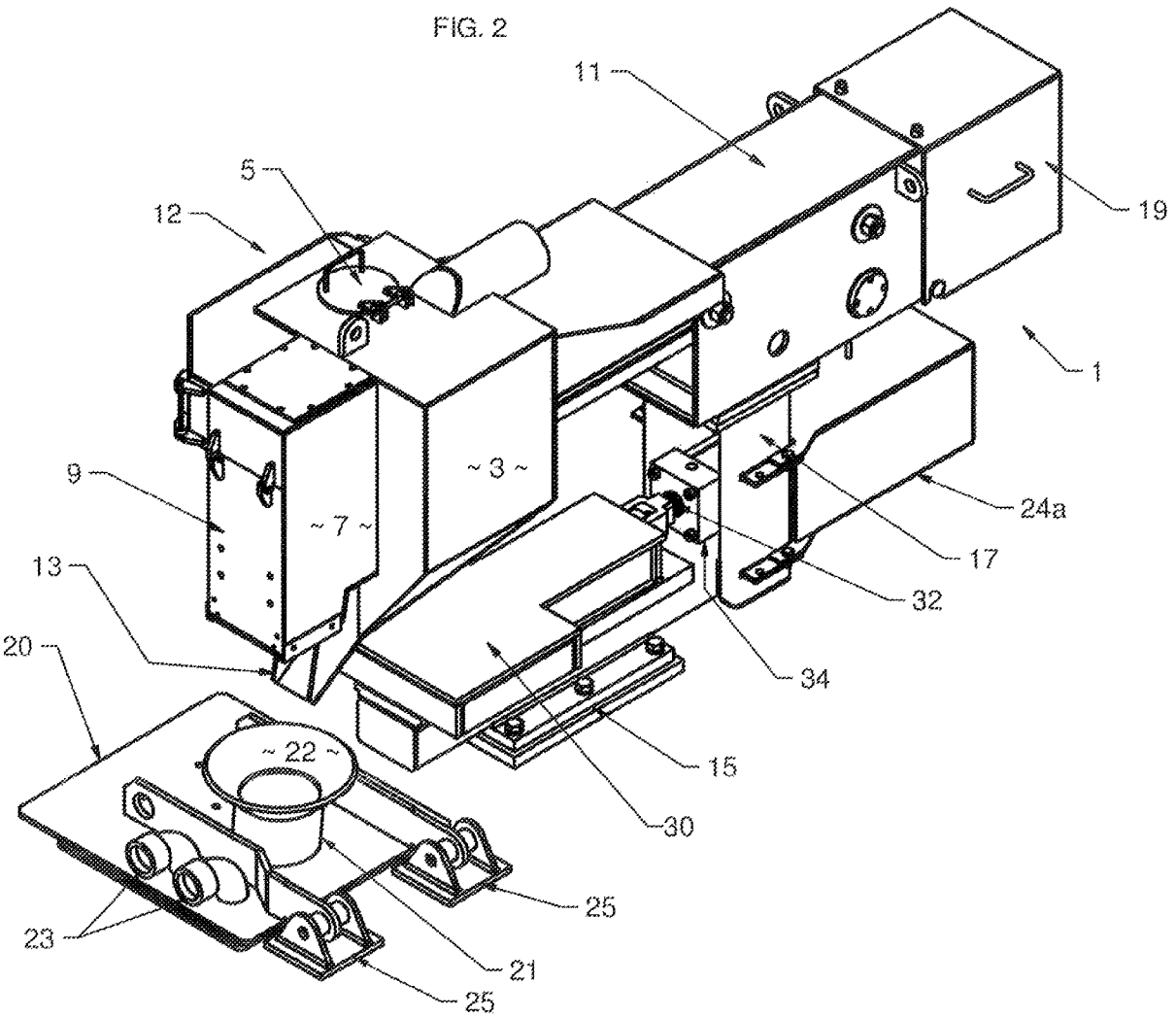
FIG. 2 is a side view in perspective of the preferred embodiment in FIG. 1 in an open position in which the sump panel door cover is retracted to expose the sump panel door.
Figure 3:
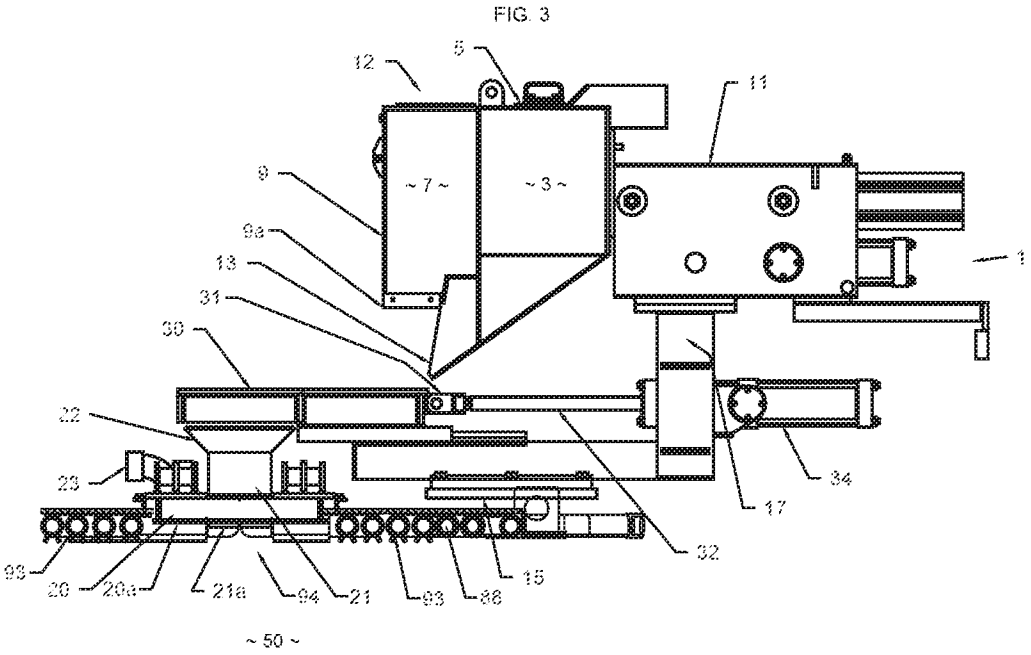
FIG. 3 is a side view of a variant of the preferred embodiment shown in the closed position (i.e., the sump panel door cover is extended over the sump panel door) illustrated in FIG. 1.

In a preferred embodiment of the invention as illustrated in FIGS. 1-4, a sand dispensing assembly 1 comprises a support base 15 for mounting the assembly 1 on a sump plate of a furnace, such as for example, a steel making furnace. Although the illustrated embodiment illustrates bolts to secure the support base 15, skilled persons will understand that other means may be used. The assembly 1 includes a retractable sump panel door cover 30 connected to a hydraulic or pneumatic arm 32 which is extended and retracted by a hydraulic or pneumatic cylinder 34. In FIGS. 1 and 3, the sump panel door cover 30 is shown in a closed position, in which the sump panel door cover 30 is covering a nozzle 21 extending through a hinged sump panel door 20. The sump panel door 20 is mounted on hinges 25, which are shown in this example as being configured for mounting on the sump panel (not shown) of a furnace (also not shown). The sump panel door cover 30 may be retracted by operation of the hydraulic or pneumatic cylinder 34 through hydraulic or pneumatic arm 32 which is connected to the sump panel door cover 30 at hinge 31.

Figure 4:
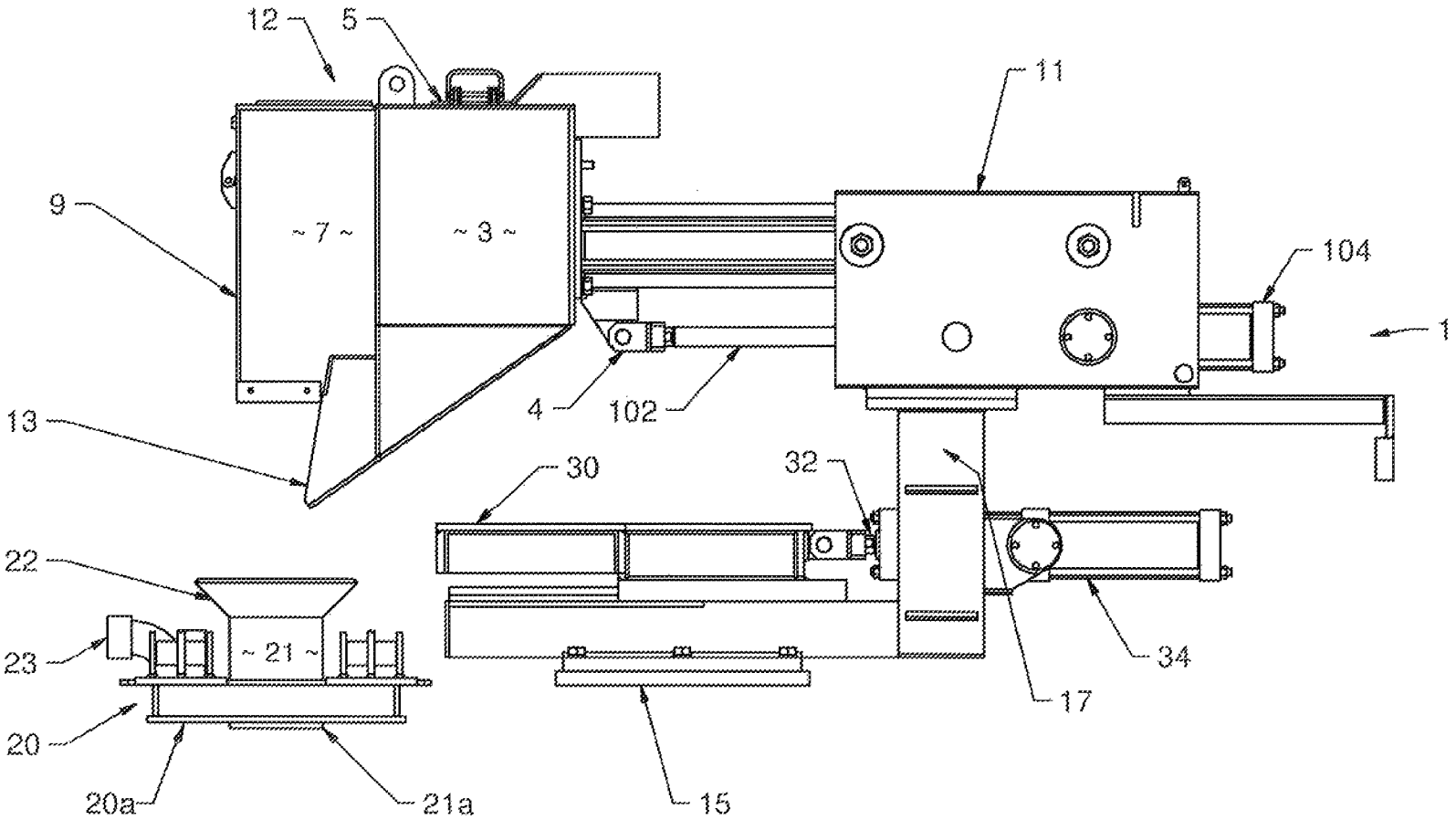
FIG. 4 is a side view of the variant of the preferred embodiment shown in the open position (i.e., the sump panel door cover is retracted) illustrated in FIG. 2.

The sand dispensing assembly 1 includes a dispenser ram housing 11 which in turn includes a stationary support column 17 and a movable reservoir assembly 12. In FIGS. 1 and 3, the movable reservoir assembly 12 is shown in a retracted position, in which the sand storage reservoir 3 and forward mounted camera housing 7 are retracted, in abutting position against support column 17, away from the sump panel door 20. In FIGS. 2 and 4, the movable reservoir assembly 12 is shown in a fully extended position, in which the camera housing 7 and sand storage reservoir 3 are moved forward by hydraulic or pneumatic cylinder 104 and hydraulic or pneumatic arm 102 connected to movable reservoir assembly 12 at coupling 4, to a position adjacent and above funnel opening 22 in nozzle 21. At this position, gated chute 13 is also oriented to dispense sand into the funnel opening 22 when the gated chute 13 is opened, to sand a tap hole 90 within the furnace 99 when the sand dispensing assembly 1, including sand storage reservoir 3, and the furnace 99 are positioned as illustrated in FIG. 5C. The configuration of the gated chute 13 may be varied to adjust the flow rate and configuration of the stream of sand flowing into the funnel opening 22, to improve the stream exiting from the opposite opening of the nozzle 21, and directed at the tap hole 90.

In the fully fitted housing illustrated in FIGS. 1 and 2, protective housings 19, 24*a* are provided to cover the rear mounted components of the sand dispensing assembly 1. Camera cover 9*a* provides a retractable cover for a camera housed within camera housing 7 so that the camera 8 may view the interior furnace chamber 50 and the tap hole 90 when the movable reservoir assembly 12 (including the camera housing 7) is extended and positioned above the funnel opening 22, and when the sump panel door cover 30 is retracted. Reservoir access door 5 may be opened to access the interior of the sand storage reservoir 3. Additional or substitute access features may be provided, as a matter of design choice.

In this embodiment, the hinged sump panel door 20 may be opened by rotating the sump panel door 20 upwardly (preferably, via remote control), across the longitudinal axis defined by the length of the assembly 1, when the sump panel door cover 30 is retracted. In the preferred embodiment, cooling couplings 23 extend from the door 20, to allow cooling fluid to circulate through a cooling area extending through the interior of the door 20, adjacent and around the nozzle 21. As shown in FIGS. 2-4, the preferred nozzle 21 is configured as an elongated straight circular tube and further configured at one end as a funnel 22, tapering inwardly toward the opening extending through the nozzle 21, toward the interior of the furnace (shown in FIGS. 5A-7C). The nozzle 21 extends through the sump panel door 20, forming a nozzle collar 21*a* which extends beyond a top interior surface 20*a* defined by the interior surface of the sump panel door 20, which faces inwardly toward the interior 50 of the furnace (shown, for example in FIGS. 5A-6C) when the sand dispensing assembly 1 is installed. In the variant of the preferred embodiment as illustrated in FIGS. 5A-7C, the sump panel door 20 is mounted on hinges so that the door may be opened by hinged movement (preferably by a remote control), along the longitudinal axis of the body of the sand dispensing assembly 1, to provide access to the interior furnace chamber 50 and the tap hole 90.

Preferably, the nozzle will be configured to have an internal diameter and shape to generate a focused, cohesive stream of a predetermined amount of sand to optimize the amount of sand needed to properly sand the tap hole of a furnace. Typically, tap holes are circular in cross section. Preferably, the nozzle in a sand dispensing system will be configured to generate a cohesive of stream of sand traveling along a suitable flight path (or trajectory) and having a suitable circular cross section with a diameter which is less than the internal diameter of the opening to the tap hole, to minimize overspray and accumulation of sand outside of the tap hole during the sanding step. To achieve such a cohesive stream of sand in the preferred embodiment, the nozzle will have a compatible internal shape and size consistent with the size and shape of the opening to the tap hole, to generate a cohesive stream of sand which will fall within the compatible target area defined by the tapered opening to the tap hole, and subsequently flow into the empty space within the tap hole.

Figure 5A:
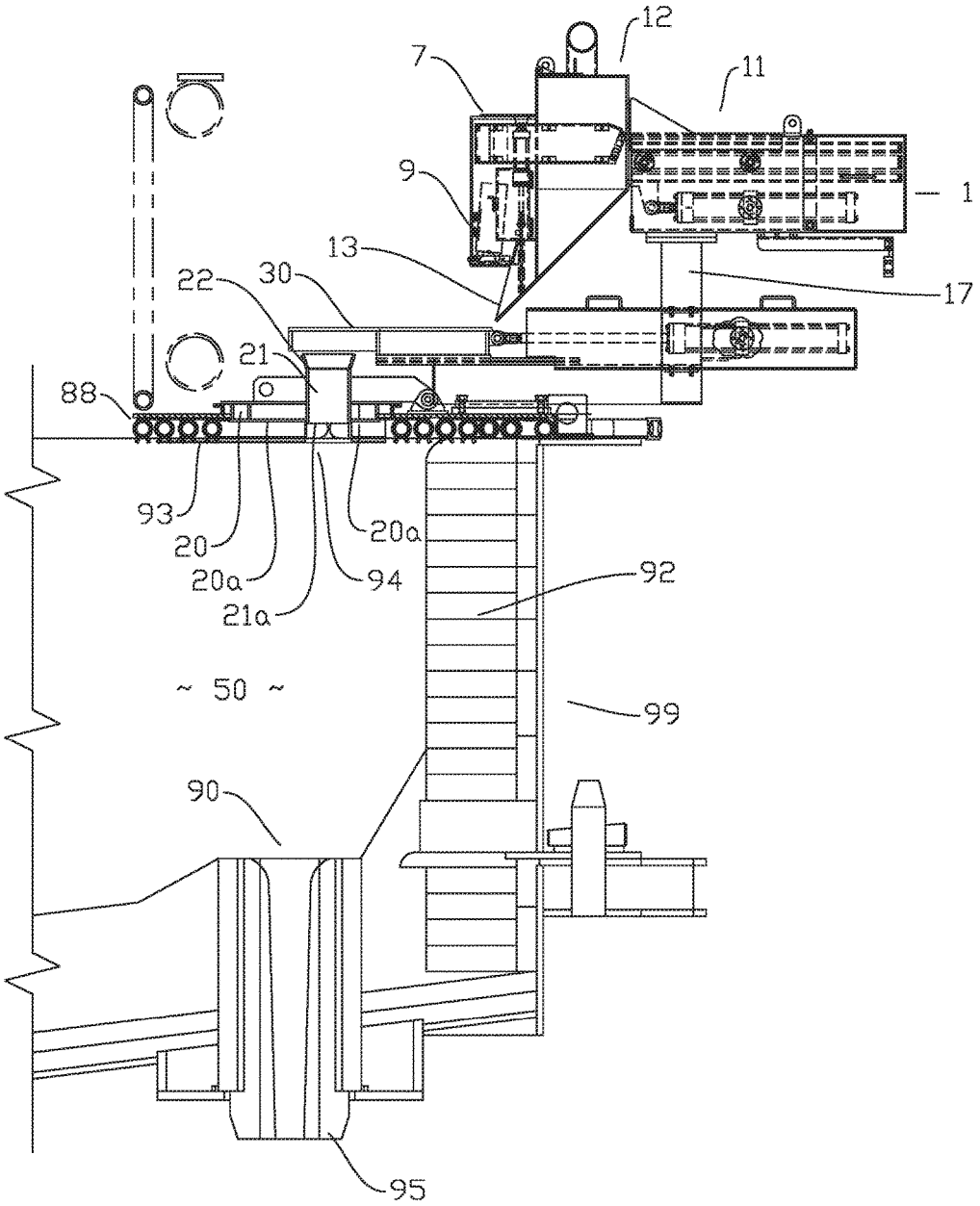
FIG. 5A is a partial side view of a variant of the preferred embodiment of the sand dispensing assembly mounted on a sump panel of a steel making furnace, for operational movement of the sand dispensing assembly along the tilt axis of the furnace, in which the sump panel door cover is closed above a sanding nozzle.
Figure 5B:
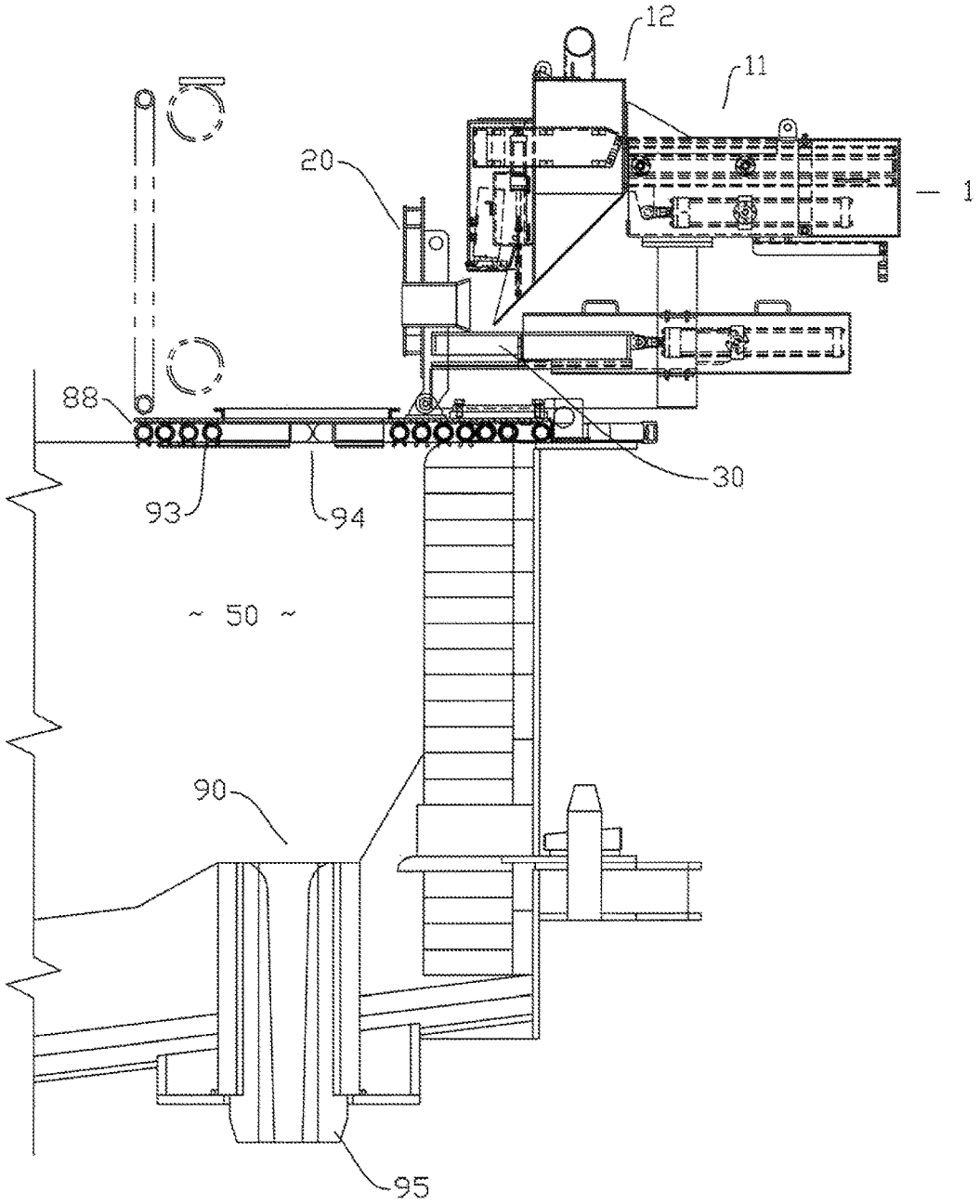
FIG. 5B is a partial side view of the variant of FIG. 5A in which the furnace is level, the sump panel door cover is retracted, and the sump panel door is opened.
Figure 5C:
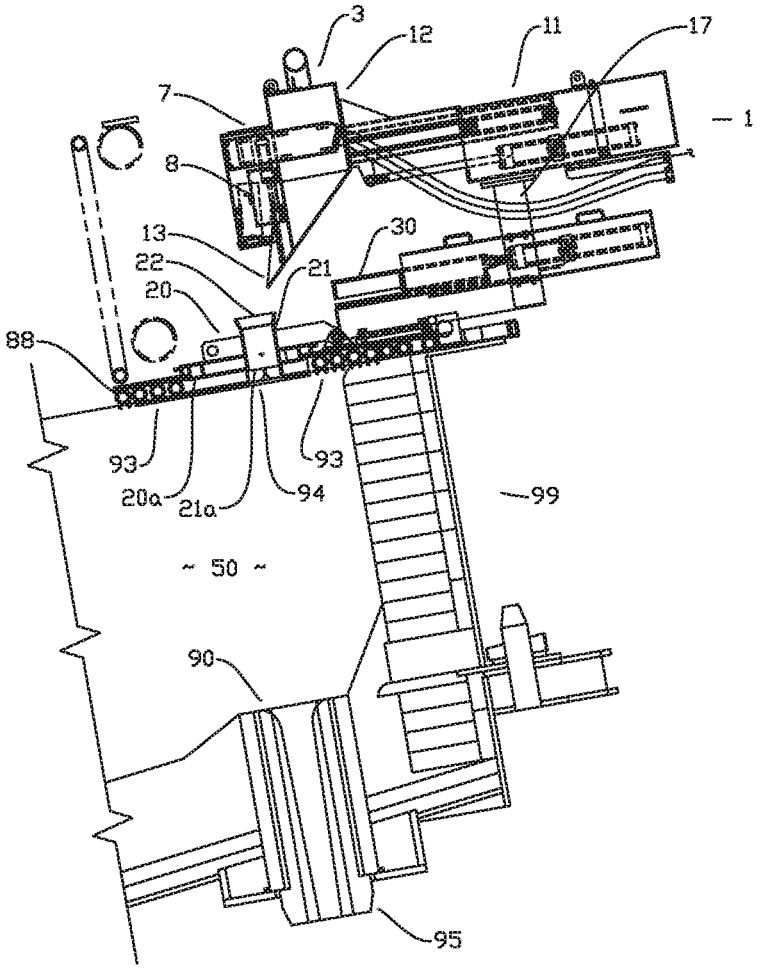
FIG. 5C is a partial side view of the variant of FIGS. 5A and 5B in which the furnace is back tilted approx. 10 degrees, and a camera and a sand storage reservoir are positioned above the sanding nozzle, in alignment with a tap hole.
Figure 6A:
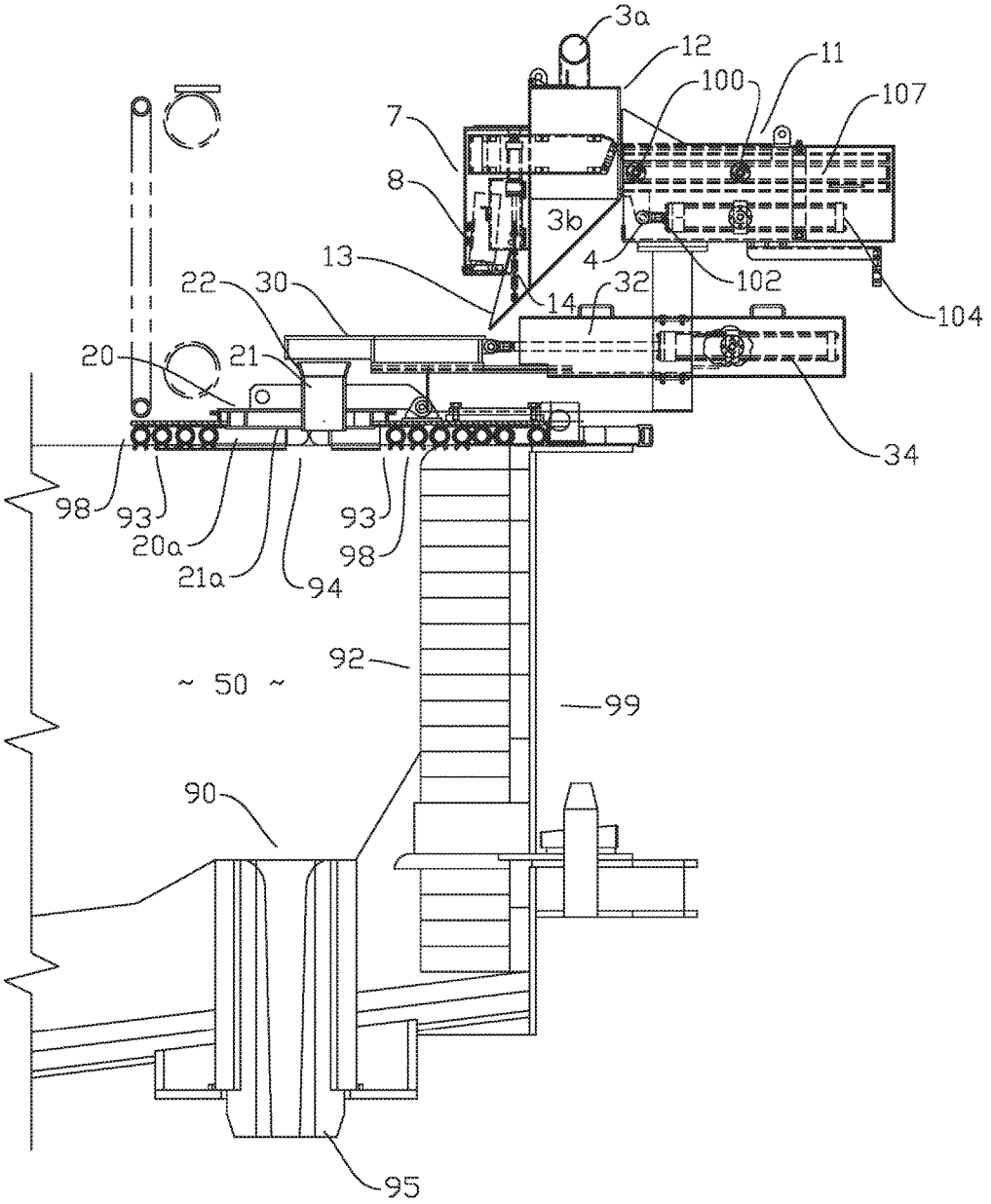
FIG. 6A is a supplemental illustration of the side view shown in FIG. 5A.
Figure 6B:
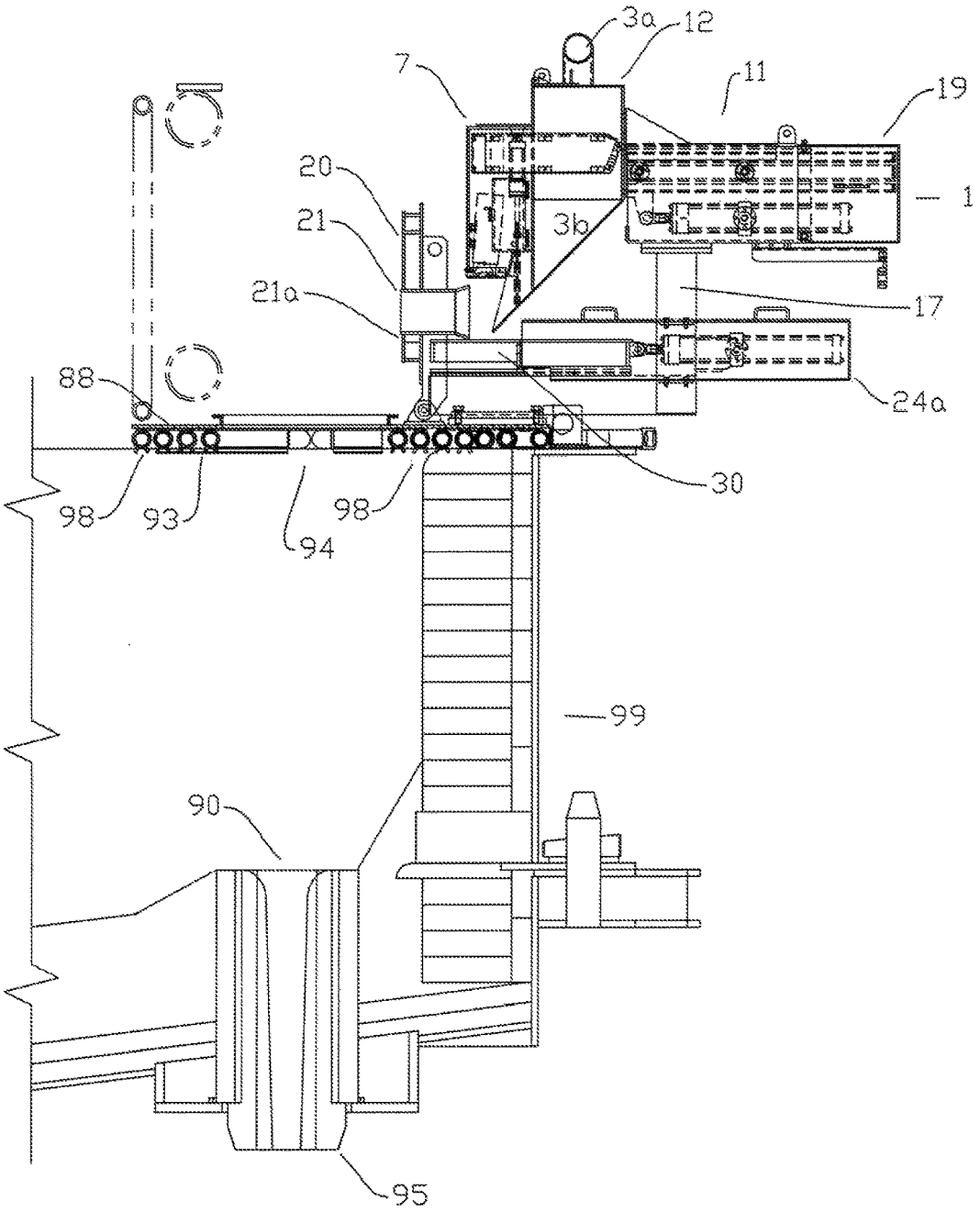
FIG. 6B is a supplemental illustration of the side view shown in FIG. 5B.
Figure 6C:
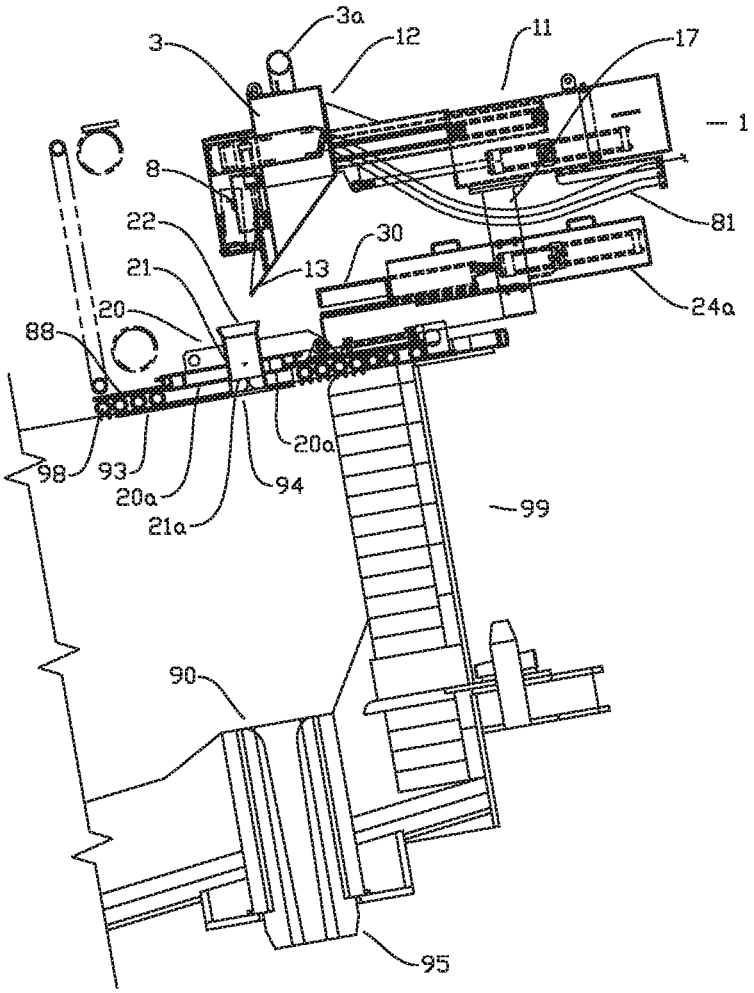
FIG. 6C is a supplemental illustration of the side view shown in FIG. 5C.
Figure 7A:
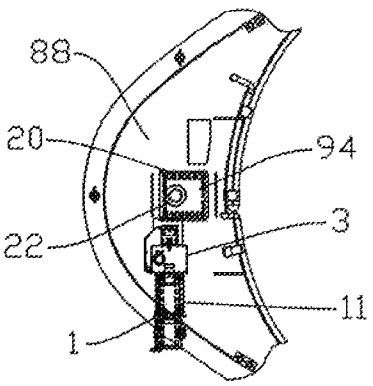
FIG. 7A is a plan view, in partial section, of another variant of the preferred embodiment of the sand dispensing system mounted atop a sump panel of a furnace, for operational movement across the tilt axis of the furnace.

To better illustrate the depicted embodiments, some of the components illustrated in the drawings, such as for example, the sand dispensing assembly 1 and the furnace 99 in FIGS. 5A, 5B, 5C, 6A, 6B, 6C, and the sump panel door 20 illustrated in FIG. 7A, are generally depicted as being transparent so that elements interior to them, behind or beneath the assembly, furnace, sump panel door, or other elements, can be seen.

In FIGS. 5A, 5B, 5C, furnace 99 defines an interior furnace chamber 50 surrounded by brick lining 92, and having a sump panel 88 which defines a sump panel opening 94 positioned above tap hole 90. (Sump panel 88 is cooled with optional internal cooling pipes 98 as shown in FIGS. 6A,6B,6C.) Tap hole 90 extends through a tap hole sleeve 95 which may be replaced when needed. The top of the interior furnace chamber 50 is defined by inside top surface 93 of sump panel 88 and the top interior surface 20*a* defined by the interior wall of the sump panel door 20 which faces inwardly toward the interior of the interior furnace chamber 50. The top interior surface 20*a* on the interior wall of sump panel door 20 is recessed, positioned outwardly away from the plane defined by the inside top surface 93 of the interior furnace chamber 50, to provide partial shelter against a build up of metal flash and other impurities adjacent the nozzle collar 21*a*, to inhibit formation of a blockage across the interior nozzle opening. The height of the collar 21*a* may also be configured to further inhibit the formation of a blockage across the nozzle opening. Similarly, optional cooling internal cooling pipes 98 may be provided to further inhibit the formation of such a blockage. One or more of these features may be provided to inhibit the formation of such blockages, thereby avoiding or reducing the need to clear debris from the interior nozzle opening, and thereby limiting the exposure of operators to a risk of injury from working closely to a heated furnace.

In FIGS. 5A, 6A, the furnace 99 is level, in the horizontal orientation, the sump panel access door 30 is in a closed position, covering the funnel opening 22 of nozzle 21, and the movable reservoir assembly 12 is retracted for operation of the furnace 99. In FIGS. 5B, 6B the furnace 99 is level, the sump panel door 20 is open (perpendicular to the sump panel 88), providing access to the interior furnace chamber 50 and the tap hole 90 while the movable reservoir assembly 12 is retracted.

In FIGS. 5C, 6C, the movable reservoir assembly 12 is fully extended while the furnace is in a back tilt position, at about 10 degrees from the horizontal, while the gated chute 13 is open, the sump panel door is closed, and the camera 8 may be used to view the tap hole 90 through the opening in the nozzle 21, to verify that the tap hole 90 is clean and unobstructed, free of debris and the like, and that it may be sanded. Insulated, heat resistant cables and hoses 81 include cables which connect camera 8 to a remote control location so that the operator may operate the camera 8 and remotely inspect the interior furnace chamber 50 and pneumatic or hydraulic hoses to activate the gate cylinder. If necessary, the sump panel door 20 may be opened as shown in FIGS. 5B, 6B to service the tap hole 90, when needed. With reference to FIGS. 5C, 6C when the operator is ready to proceed with the sanding operation, the gated chute 13 may be opened when it is positioned above funnel opening 22 of nozzle 21, so that the nozzle 21 may direct a cohesive, well defined stream of a predetermined amount of sand into the tap hole opening 90. After the predetermined amount of sand is dispensed, the gated chute 13 will close, and the operator may use the camera 8 to verify that the tap hole 90 is properly filled with sand before proceeding with operation of the furnace.

With reference to FIGS. 6A, 6B, 6C, the sand storage reservoir 3 in the movable reservoir assembly 12 defines a sand box 3*b*, which is supplied with a predetermined amount of sand through a sand feedline coupling 3*a*. When the gate 14 is closed so that sand will not escape from the sand box 3*b*, and preferably when the movable reservoir assembly 12 is retracted away from the sump panel door 20, a new predetermined amount of sand is charged into the sand box 3*b*. Typically, the new predetermined amount of sand may be supplied by suitable means (for example, by gravity feed, pneumatically, or mechanical conveyances such as a screw, conveyor belt, container, or otherwise), from a remote bulk storage facility, conveniently located at a suitable location away from the furnace 99.

The predetermined amount of sand may be measured and controlled at the sand reservoir assembly or elsewhere. For example, the volume of sand held within the sand box 3*b* of the sand storage reservoir 3 may be adjusted to be the optimal maximum amount of sand needed to sand a worn tap hole as it approaches the end of its working life. Preferably, the predetermined amount of sand will be adjustable so that an adequate amount of sand will be delivered to the tap hole, to ensure proper sanding of the tap hole. Preferably, the predetermined amount of sand will be adjustable from a remote location, from a remote control center. In some instances, it may be desirable to incorporate the volumetric control for sand into an automated control system for the sanding step.

As shown in the embodiment illustrated in FIGS. 6A, 6B, 6C, the movable reservoir assembly 12, including the camera 8, travels on rollers 100 which move along a telescoping track 107.

Figure 7B:
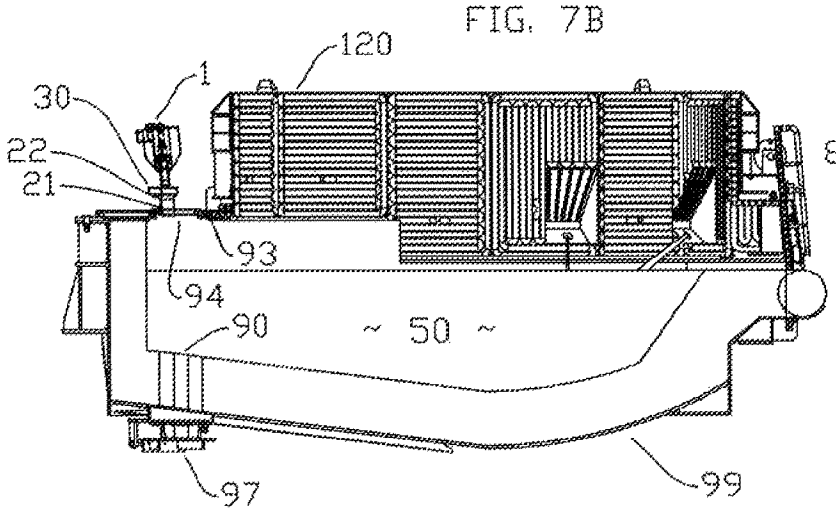
FIG. 7B is a side view of a furnace on which the variant of the preferred embodiment of the sand dispensing assembly shown in FIG. 7A, in which the furnace and sand dispensing assembly are in a level position.
Figure 7C:
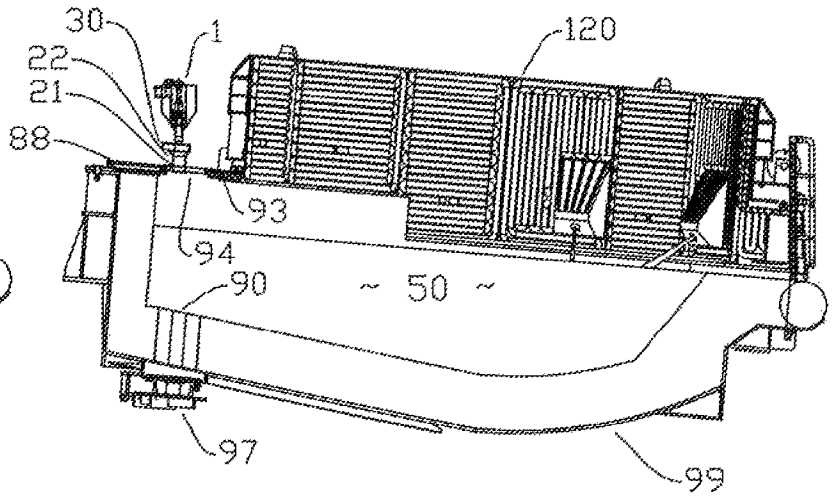
FIG. 7C is a side view of the furnace of FIG. 7A in which the furnace and the sand dispending assembly are back tilted approximately 10 degrees.

FIGS. 7A, 7B, 7C illustrate an example of a steel making furnace 99 supporting a heat exchanger assembly 120 and another variant of the preferred embodiment of the sand dispensing assembly 1, positioned in a tilted orientation, for operation movement of the sand dispensing assembly across the tilt axis defined by the furnace 99. The modified sand dispensing assembly 1 is mounted, at a tilt angle, atop the sump panel 88 of the furnace 99, allowing the sand dispensing assembly 1 to travel along with the furnace 99 when the furnace is tilted. The sand dispensing assembly 1 is modified to accommodate the tilted orientation of the assembly and the different configuration of the support base 15 and the slanted top of the funnel 22 (in comparison to the variant illustrated in FIGS. 5A-6C in which that sand dispensing assembly is configured and positioned for operational movement along the tilt axis of the furnace). The furnace 99 has a tap hole gate 97 which opens, to release the sand plug within the tap hole 90, and release the molten contents of the furnace 99 at the end of the production cycle, when the furnace 99 is forward tilted toward the tap hole 90 (however, the forward tilt position of the furnace and the sand dispensing assembly is not shown).

Various heat resistant, protective, and insulating materials may be used to make or assemble the components of the sand dispensing system, as would be evident to a skilled person.

In another preferred embodiment of the present invention, a method of dispensing sand into a tap hole within a furnace, such as a steel making furnace includes the following steps:

- moving the sand storage reservoir 3 to a position adjacent the sump panel opening 94 defined by a steel making furnace 99 so that the gated chute 13 is positioned above the nozzle 21;
- operating the sump panel door cover 30 to open the funnel opening 22 of the nozzle 21 provided in the sump panel door 20 when the sump panel door 20 is positioned to close the sump panel opening 94; and
- dispensing the predetermined amount of sand from the movable sand storage reservoir 3 by directing a cohesive stream of the predetermined amount of sand, via the nozzle 21 extending through the sump panel door 20, sufficient to fill the tap hole 90 within the steel making furnace 99, when the sand storage reservoir 3 is positioned adjacent the sump panel opening 94. Preferably, the diameter of the stream of sand directed into the tap hole 90 is smaller than the diameter of the tap hole 90. Also, in the preferred embodiment, the dispensing step is carried out by opening gate 14 in gated chute 13, to allow the predetermined amount of sand to flow from pre-charged sand box 3*a*.

After the predetermined amount of sand is dispensed into the tap hole 90, the movable sand reservoir 3 is returned to its distal position, away from the sump panel opening 94. The sump panel door cover 30 is moved to cover the funnel opening 22 of the nozzle 21, to close the funnel opening 22 into the interior furnace chamber 50. Sand is recharged into the sand box 3*b*, preferably while sand reservoir 3 is in the distal position. Preferably, the amount of sand recharged into the sand box 3*b* is equal to the predetermined amount of sand. The predetermined amount of sand to be charged into the sand box 3*b* may be adjusted, if needed, in the preferred embodiment.

Preferably, an imaging device such as camera 8 is remotely operated for remotely viewing the tap hole 90, through the funnel opening 22 in nozzle 21. The camera permits a remotely located operator to view the tap hole 90 when the sump panel door cover 30 is retracted to open the funnel opening 22. The movable reservoir assembly 12, including the camera 8, are positioned in proper alignment above the funnel opening 22, to see into the interior furnace chamber 50, and particularly, to allow the operator to see the condition of the tap hole 90, before and after sanding of the tap hole 90.

Preferably, these method steps are controlled from a remote location. In some instances, the steps may be controlled by an automated control system programmed for variable operation and control from a remote location.

It should be understood that the above-described embodiment(s) of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. For example, the order of steps listed in the preferred embodiment or other examples mentioned herein does not imply that the actual order of those steps must be carried out when the invention is implemented. Persons skilled in the art will appreciate that, in some instances, the order of such steps may be varied.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "having", "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

Nothing in this specification or the claims that follow is to be construed as a promise.

The scope of the claims that follow is not limited by the embodiments set forth in the description. The claims should be given the broadest purposive construction consistent with the description as a whole.

PARTS LIST

FIG. 1
1 sand dispensing assembly
3 sand storage reservoir
5 reservoir access and venting door
7 camera and gate cylinder housing
9 camera access door
11 dispenser ram housing
12 mobile reservoir assembly
13 (gated) chute
15 support base
17 support column
19 service hatch/guard
20 sump panel door
21 nozzle
22 cooling couplings
25 sump panel door hinges
30 sump panel door cover
32 hydraulic or pneumatic arm
34 hydraulic or pneumatic cylinder
FIG. 2
22 funnel
24*a* protective housings
FIG. 3
9*a* camera cover
31 arm/cover coupling
20*a* door interior surface
21*a* nozzle collar
FIG. 4
4 reservoir/arm coupling
102 sand box hydraulic or pneumatic arm
104 sand box hydraulic or pneumatic cylinder
FIG. 5A, 5B, 5C
8. camera
50 interior of furnace (furnace chamber)
88 sump panel
90 tap hole
92 lining
93 inside sump panel top surface
94 sump panel opening
95 tap hole sleeve
99 furnace
FIG. 6A, 6B, 6C
3*a* feedline coupling
3*b* sand box
14 gate
81 camera cabling and hydraulic or pneumatice gate cylinder hoses
98 cooling pipes
100 rollers
107 telescoping track
FIG. 7A, 7B, 7C
97 tap hole gate
120 heat exchanger (piping and fluid)

I claim:

1. A sand dispensing system comprising:

a movable sand storage reservoir for dispensing a remotely adjustable predetermined amount of sand, the sand storage reservoir moving between a first position away from a sump panel opening defined by a metal making furnace and a second position adjacent the sump panel opening, a sump panel door for closing and opening the sump panel opening, and a nozzle extending through the sump panel door and defining a first open end extending inwardly beyond a top interior surface defined within the metal making furnace and the first open end is positioned remotely away from a tap hole within the metal making furnace, the nozzle directing the predetermined amount of sand in a stream flowing into the tap hole when the sand storage reservoir is in the second position, and wherein the predetermined amount of sand is sufficient to fill the tap hole.

2. In the sand dispensing system claimed in claim 1, the nozzle directs the stream with a stream diameter less than an opening diameter defined by the tap hole.

3. In the sand dispensing system claimed in claim 1, the nozzle defines a second open end projecting outwardly from the furnace, the second open end comprising a funnel for receiving the predetermined amount of sand from the sand storage reservoir when the sand storage reservoir is in the second position.

4. In the sand dispensing system claimed in claim 2, the nozzle defines a second open end for receiving the predetermined amount of sand from the sand storage reservoir when the sand storage reservoir is in the second position.

5. In the sand dispensing system claimed in claim 4, the first open end of the nozzle extending inwardly beyond the top interior surface, the top interior surface being defined by the sump panel door, and the first open end of the nozzle terminating within a recess positioned outwardly from an inside top surface of an interior chamber of the metal making furnace.

6. The sand dispensing system claimed in claim 1, comprising a sump panel door cover moving between a first cover position for closing a second open end of the nozzle when the sand storage reservoir is in the first position and a second cover position for opening the second open end of the nozzle when the sand storage reservoir is in the second position.

7. The sand dispensing system claimed in claim 1, wherein the sand storage reservoir is configured to release the predetermined amount of sand into the stream, the stream defining a cohesive flow of sand into an opening defined by the tap hole and forming a sand plug to fill the tap hole.

8. In the sand dispensing system claimed in claim 4, the sand storage reservoir defines a volume capacity equal to the predetermined amount of sand.

9. In the sand dispensing system claimed in claim 3, the sand storage reservoir is configured to define a volume capacity equal to the predetermined amount of sand, and the sand dispensing system is configured to refill the sand storage reservoir with sand after a tap hole filling cycle.

10. In the sand dispensing system claimed in claim 6, the sand storage reservoir is configured to discharge one predetermined amount of sand into the second open end of the nozzle, and the first open end of the nozzle is configured to direct the stream with a stream diameter less than an opening diameter defined by the tap hole, and into the tap hole when the sand storage reservoir is in the second position.

11. The sand dispensing system claimed in claim 6, wherein the sand storage reservoir is configured to be mounted atop a sump panel on the metal making furnace so that the sand storage reservoir moves above the sump panel between the first position away from the sump panel opening and the second position adjacent the sump panel opening.

12. The sand dispensing system claimed in claim 1, comprising a remote control or automated control for operation of:

the sand storage reservoir between the first position away from the sump panel opening and the second position adjacent the sump panel opening, a gate to dispense the predetermined amount of sand from the sand storage reservoir into the nozzle, wherein the predetermined amount of sand is equal to a fill volume defined by the tap hole, a sump panel door cover between a first cover position for closing the nozzle when the sand storage reservoir is in the first position and a second cover position for opening the nozzle when the sand storage reservoir is in the second position, and an imaging device for remotely viewing the tap hole through the nozzle when the sump panel door cover is in the second cover position for opening the nozzle.

13. In the sand dispensing system claimed in claim 12, the imaging device is remotely controlled for viewing the tap hole before the tap hole is filled with the predetermined amount of sand and for viewing the tap hole after the tap hole is filled with the predetermined amount of sand.

14. In the sand dispensing system claimed in claim 1, the sand storage reservoir defines a volume capacity equal to the predetermined amount of sand, and the sand storage reservoir is configured to be mounted atop the metal making furnace and for tipping along with the furnace during operational movement of the furnace.

15. A method of dispensing sand from a movable sand storage reservoir, comprising:

moving the sand storage reservoir between a first position away from a sump panel opening defined by a steel making furnace and a second position adjacent the sump panel opening, operating a sump panel door cover between a first cover position for closing a nozzle and a second cover position for opening the nozzle, the nozzle extending through a sump panel door positioned above the sump panel opening, the nozzle defining a first open end extending into the interior of the steel making furnace, the first open end being positioned remotely from a tap hole within the steel making furnace, dispensing a predetermined amount of sand from the sand storage reservoir into a second open end of the nozzle, and directing the predetermined amount of sand in a cohesive stream having a stream diameter less than an opening diameter defined by the tap hole, via the first open end of the nozzle, sufficient to fill the tap hole, when the sand storage reservoir is in the second position.

16. The method of claim 15, wherein the nozzle is sufficiently vertically aligned with the tap hole when the sand storage reservoir is in the second position, to direct the cohesive stream into the tap hole.

17. In the method of claim 15, the predetermined amount of sand is released from the sand storage reservoir by opening a gate, into a funnel defined at the second open end of the nozzle and the stream flows through the first open end of the nozzle extending inwardly beyond the top interior surface, the top interior surface being defined by the sump panel door, and the first open end of the nozzle terminating within a recess positioned outwardly from an inside top surface of an interior chamber of the metal making furnace.

18. The method of claim 15 comprising using an imaging device for remotely viewing the tap hole through the nozzle when the sump panel door cover is in the second cover position for opening the nozzle and the sand storage reservoir is in the second position.

19. An automated or manually controlled sand dispensing system comprising:

a movable sand storage reservoir configured for mounting atop a metal making furnace for tilting movement along with the furnace and to hold and selectively dispense one predetermined amount of sand sufficient to fill a tap hole in the furnace, a sump panel door for closing and opening a sump panel opening defined by a top interior surface within the furnace, a nozzle extending through the sump panel door inwardly beyond a portion of the top interior surface of the furnace defined by a recessed interior surface of the sump panel door which faces inwardly toward the interior of the furnace, to direct a cohesive stream of the predetermined amount of sand into an opening defined by the tap hole when the nozzle is aligned with the opening to the tap hole, a sump panel door cover for opening and closing the nozzle, an imaging device for remotely viewing the tap hole through the nozzle when the sump panel door cover is retracted for opening the nozzle, and a remote control for operation of:

the sand storage reservoir, the sump panel door, a gate to dispense the predetermined amount of sand from the storage reservoir into the nozzle when the sump panel door cover is in the second cover position for opening the nozzle, and the imaging device.

20. In the sand dispensing system claimed in claim 19, the nozzle is positioned remotely from the tap hole and a first open end of the nozzle terminates within the interior recessed surface and outwardly of an inside top surface of an interior chamber of the furnace.

21. The sand dispensing system claimed in claim 19 wherein the nozzle comprises a funnel at a second open end to receive sand dispensed from the sand storage reservoir, and an opening area measured across the internal diameter of the nozzle defines a minor portion of a total area defined by the sump panel opening.

22. In the sand dispensing system claimed in claim 21, the internal diameter of the nozzle is about 5 to 6 inches for use in a sump panel opening with a diameter of about 18 to 20 inches, or a rectangular sump panel opening wherein each side has a length between 18 to 20 inches.

23. The sand dispensing system claimed in claim 19, configured to remotely control the predetermined amount of sand to offset a variation in the fill volume of the tap hole.

24. In the sand dispensing system claimed in claim 19, the nozzle defines a first open end extending inwardly beyond the recessed interior surface defined by the sump panel door and the first open end is positioned remotely away from the tap hole.

25. A steel making furnace comprising the sand dispensing system claimed in claim 19, wherein the nozzle defines an internal diameter which is smaller than an internal diameter defined by an opening to the tap hole, to direct the cohesive stream of the predetermined amount of sand into the opening to the tap hole.

26. In the sand dispensing system claimed in claim 19, the nozzle is configured to direct the cohesive stream of the predetermined amount of sand into the tap hole with a stream diameter smaller than the internal diameter defined by the opening to the tap hole, and the predetermined amount of sand being equal to the volume capacity of the tap hole.

27. In the steel making furnace claimed in claim 25, a volume capacity defined by the sand storage reservoir is adjustable to compensate for variation in the volume capacity of the tap hole.

28. A steel making furnace comprising the sand dispensing system claimed in claim 1, and an internal array of cooling pipes above the interior surface of the furnace and adjacent the sump panel opening to inhibit formation of a blockage at the first open end of the nozzle.

29. The method claimed in claim 15, comprising the step of cooling the top interior surface of the furnace chamber adjacent the sump panel opening, to inhibit formation of a blockage at the first open end of the nozzle during operation of the steel making furnace.

30. The method claimed in claim 17, further comprising the step of cooling the top interior surface of the furnace chamber at the sump panel opening to inhibit formation of a blockage at the first end of the nozzle.

31. The steel making furnace claimed in claim 25, wherein an internal array of cooling pipes is configured above the top interior surface of the furnace, to inhibit formation of a blockage at the first open end of the nozzle.

32. The steel making furnace claimed in claim 27, further comprising a plurality of cooling pipes, configured at the sump panel door and above the top interior surface of the furnace, to inhibit formation of a blockage at an interior opening of the nozzle during a steel making operation of the furnace.

33. A steel making furnace comprising the sand dispensing system claimed in claim 1, wherein the sump panel door defines an internal cooling area to inhibit formation of a blockage at the first open end of the nozzle.

34. The method claimed in claim 15, further comprising the step of cooling an internal cooling area of the sump panel door adjacent the first open end of the nozzle during operation of the steel making furnace.

35. The method claimed in claim 17, further comprising the step of cooling an internal area of the sump panel door to inhibit formation of a blockage at the first end of the nozzle.

36. The steel making furnace claimed in claim 25, wherein an internal cooling area is configured within the sump panel door adjacent to the nozzle to inhibit formation of a blockage at the first open end of the nozzle.

37. The steel making furnace as claimed in claim 27, wherein an internal cooling area is configured within the sump panel door and surrounding the nozzle, to inhibit formation of a blockage at an interior opening of the nozzle during a steel-making operation of the furnace.

38. The sand dispensing system as claimed in claim 1, wherein the sump panel door comprises cooling couplings configured to circulate cooling fluid within an interior area extending through the sump panel door and around the nozzle.

* * * * *